United States Patent [19]

Bauer

[11] 4,045,759

[45] Aug. 30, 1977

[54] CUT-BACK THERMOSTAT CONSTRUCTION

[75] Inventor: Werner R. Bauer, Radnor, Pa.

[73] Assignee: Robertshaw Controls Company, Richmond, Va.

[21] Appl. No.: 644,611

[22] Filed: Dec. 29, 1975

[51] Int. Cl.[2] ..... H01H 37/62

[52] U.S. Cl. ..... 337/301; 337/302

[58] Field of Search ..... 219/492; 337/51, 115, 337/116, 102, 100, 107, 301, 302, 138, 236

[56] References Cited

U.S. PATENT DOCUMENTS

| | | | |
|---|---|---|---|
| 2,262,962 | 11/1941 | Pierson | 337/301 X |
| 3,036,470 | 5/1962 | Houser et al. | 337/301 X |
| 3,825,872 | 7/1974 | Sadler et al. | 337/301 |

*Primary Examiner*—George Harris

*Attorney, Agent, or Firm*—Candor, Candor & Tassone

[57] ABSTRACT

A cut-back thermostat construction having a frame carrying a timer and a thermostat arrangement. A movable actuator is carried by the frame and is operatively associated with the thermostat arrangement to cut back the temperature setting thereof when the actuator is moved from a first position thereof to a second position thereof, the timer having a cut-back member for engaging and moving the actuator from the first position thereof to the second position thereof when a predetermined time is reached by the timer whereby the temperature setting of the thermostat arrangement is cut back at the predetermined time.

17 Claims, 7 Drawing Figures

CUT-BACK THERMOSTAT CONSTRUCTION

This invention relates to an improved cut-back thermostat construction.

It is well known that cut-back thermostat constructions have been provided wherein each has a timer means for causing the thermostat unit thereof to be automatically turned back to a lower temperature when the timer reaches a preselected time. For example, such a cut-back thermostat construction can be set to cut back the thermostat setting thereof from its normal high temperature daytime setting to a low temperature night-time setting when the timer reaches a selected time period. Such thermostat construction can also automatically reset the thermostat setting back to the day-time setting thereof when the timer subsequently reaches another predetermined time period thereof, such as in the morning. In this manner, a savings in energy used and cost will automatically result.

It is a feature of this invention to provide an improved cut-back thermostat construction of the above type having improved means for operating the thermostat arrangement by the timer means thereof.

In particular, one embodiment of this invention provides a cut-back thermostat construction having a frame means carrying a timer means and a thermostat arrangement. A movable actuator means is carried by the frame means and is operatively associated with the thermostat arrangement to cut-back the temperature setting thereof when the actuator means is moved from a first position thereof to a second position thereof, the timer means having cut-back means for engaging and moving the actuator means from the first position thereof to the second position thereof when a predetermined time is reached by the timer means whereby the temperature setting of the thermostat arrangement is cut back at the predetermined time.

The thermostat arrangement of such embodiment can comprise an elecrtrical switch means carried by the frame means and a temperature responsive switch operator movably carried by the frame means for operating the switch means in accordance with sensed temperature.

In one embodiment of the thermostat construction of this invention, the switch means is movable carried by the frame means and the actuator means is operatively associated with the switch means to move the same relative to the switch operator to cut back the temperature setting of the thermostat arrangement when the actuator means is moved from the first position thereof to the second position thereof.

In another embodiment of the thermostat construction of this invention, the actuator means cuts back the temperature setting of the thermostat arrangement by adjusting the temperature responsive switch operator relative to a fixed switch means.

Accordingly, it is an object of this invention to provide an improved cut-back thermostat construction having one or more of the novel features set forth above or hereinafter shown or described.

Other objects, uses and advantages of this invention are apparent from a reading of this description which proceeds with reference to the accompanying drawings forming a part thereof and wherein.

Figure 1:
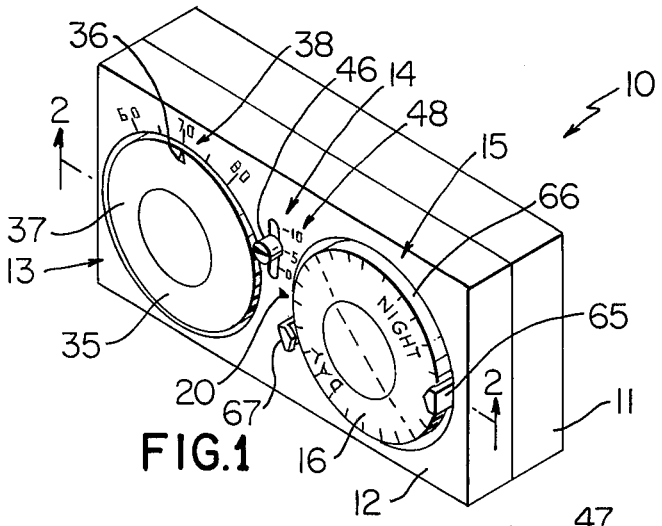
FIG. 1 is a front perspective view of the improved cut-back thermostat construction of this invention.

While the various features of this invention are hereinafter described and illustrated as being particularly adapted to provide a cut-back thermostat construction for operating a heat exchange unit for a building or residence, it is to be understood that the various features of this invention can be utilized singly or in any combination thereof to provide a cut-back thermostat construction for other apparatus as desired.

Therefore, this invention is not to be limited to only the embodiments illustrated in the drawings, because the drawings are merely utilized to illustrate one of the wide variety of uses of this invention.

Figure 2:
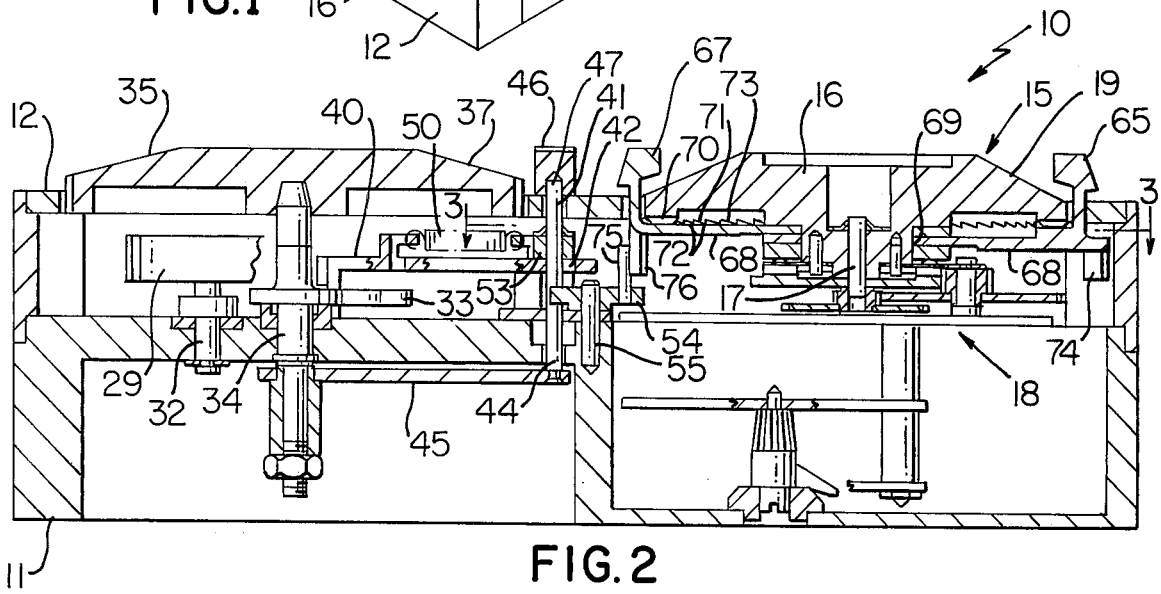
FIG. 2 is an enlarged cross-sectional view taken substantially on line 2—2 of FIG. 1.
Figure 3:
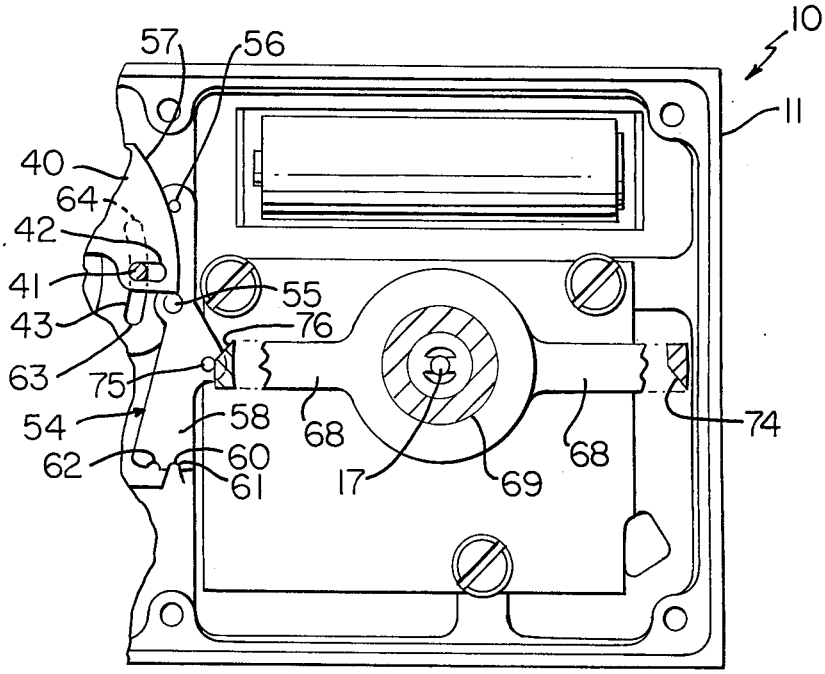
FIG. 3 is a fragmentary, cross-sectional view taken substantially on line 3—3 of FIG. 2.

Referring now to FIGS. 1, 2, and 3, the improved thermostat construction of this invention is generally indicated by the reference numeral 10 and comprise a frame means 11 carrying a cover means 12 that is divided into a temperature setting portion 13, a temperature cut-back setting portion 14 and a timer portion 15.

The timer portion 15 of the thermostat construction 10 includes a timer dial member 16 rotatably mounted to the frame means 11 by a shaft means 17 and being driven by a conventional electrically operated motor (not shown) through a suitable gear train 18 so that the timer dial member 16 will rotate 360° every twenty-four hours, the timer dial member 16 having time indication on the outer surface 19 thereof to indicate the time of day by its relation relative to an indicating mark 20, FIG. 1, on the front cover 12.

Figure 4:
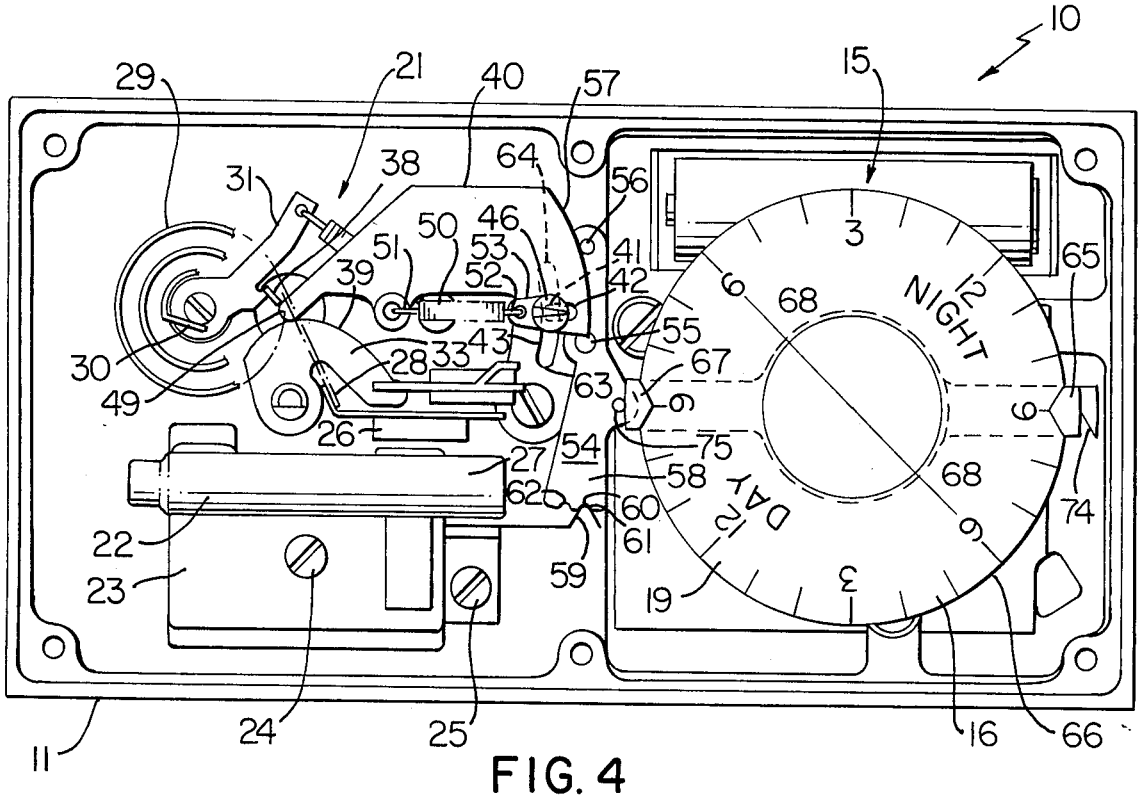
FIG. 4 is a top view of the thermostat construction of FIG. 2 with the top cover and certain parts thereof removed, the thermostat construction of FIG. 4 being in its day-time condition.
Figure 5:
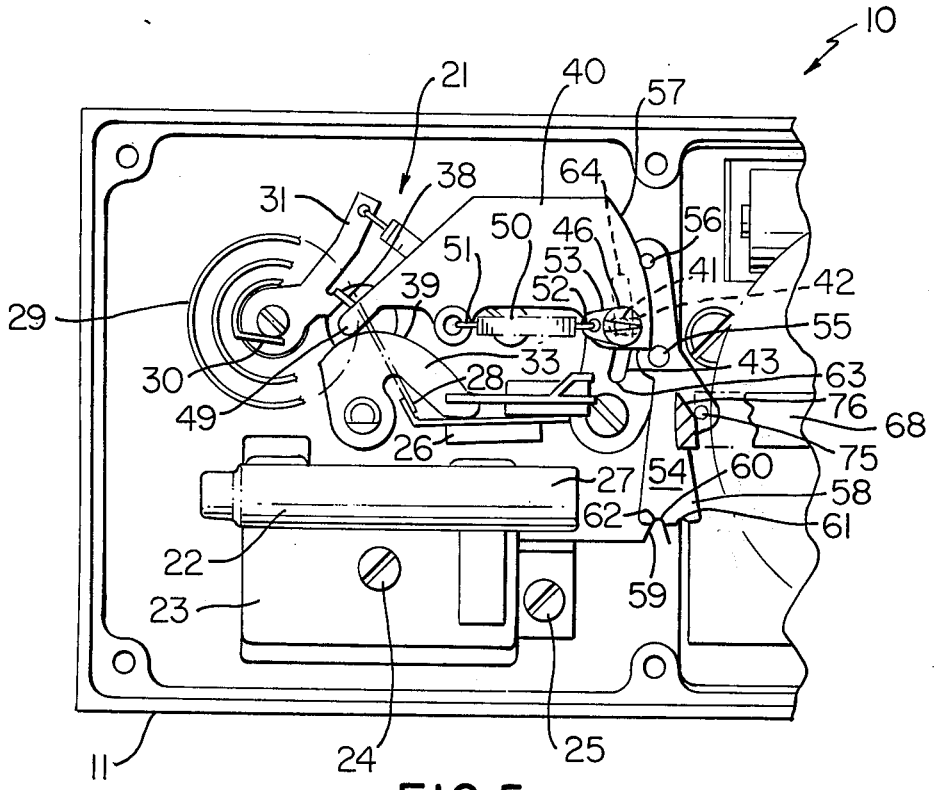
FIG. 5 is a fragmentary view similar to FIG. 4 and illustrates the thermostat construction in its night-time condition.

The frame means 11 carries a thermostat arrangement that is generally indicated by the reference numeral 21 in FIGS. 4 and 5 and comprising an electrical switch unit 22 fixed to a plate member 23 that, in turn, is fixed to the frame means 11 by fastening means 24 and 25. The thermostat arrangement 21 also includes a magnet armature or switch operator 26 that is adapted to control the operation of the switch 22 by causing the same to be in one condition thereof when the armature 26 is disposed closely adjacent or against the outer periphery 27 of the switch unit 22 and to cause the same to be in another condition thereof when the armature 26 is disposed away from the periphery 27 of the switch 22 as illustrated in FIG. 4.

The switch 22 is adapted to operate a heat exchange system (not shown) by turning on the heat exchange system when the switch 22 is in one condition thereof and turning off the heat exchange system when the switch 22 is in the other condition thereof.

The magnet armature or switch operator 26 is carried on and end 28 of a bimetal member 29 that is disposed in a spiral, coil relation and has its inner end 30 fastened to a cam follower 31 that is rotatably mounted to the frame means 11 by a shaft means 32, FIG. 2.

An adjustable cam 33 is rotatably mounted to the frame means 11 by a shaft means 34 which has a temperature setting dial member 35 fastened to the upper end thereof and having an indicator pointer 36, FIG. 1, on the outer surface 37 thereof for being positioned relative to a temperature scale 38 provided on the front cover 12 and forming the temperature setting portion 13 thereof.

The cam follower 31 has an abutment or finger 38 which would normally ride on the cam surface 39 of the adjustable cam 33 whereby rotation of the cam 33 will provide a selected temperature setting for the bimetal member 29. Thus, the bimetal member 29 will move the armature or switch operator 36 against the switch unit 22 when the output temperature effect of the heat exchange system, or unit, falls below the temperature setting of the dial member 35 so that the thus operated switch 22 will turn on the heat exchange unit to increase the output temperature effect thereof. When the output temperature effect of the heat exchange unit increases to or slightly above the temperature setting of the dial member 35, the bimetal member 29 moves the armature or switch operator 26 away from the outer periphery 27 of the switch unit 22 in a manner illustrated in FIG. 4 to cause the switch unit 22 to turn off the heat exchange unit.

However, it was found according to the teachings of this invention, that means could be provided for automatically cutting back the temperature setting of the thermostat arrangement 21 by inserting a wedge between the cam follower finger 38 and the adjustable cam 33 so that movement of the wedge from a normal position thereof to another position thereof would effectively change the temperature setting that the bimetal member 29 will control the heat exchange unit in the above manner.

Accordingly, a wedge member 40 is movably carried by the frame means 11 by receiving a pin 41 through an elongated slot 42 thereof with the pin 41 itself being arcuately movable relative to the frame means 11 by passing through an arcuate slot 43 thereof and having its lower end 44 fastened to a lever 45 that is rotatably mounted to the shaft 34 of the temperature setting dial 35. In this manner, the pin 41 can be adjusted to any position within the arcuate slot 43 of the frame means 11 by grasping a knob 46 secured to the upper end 47 of the pin 41 and moving the same relative to a cut-back temperature scale 48 on the front cover 12 of the thermostat construction 10 for a purpose thereinafter described.

The wedge member 40 has a finger end 39 disposed between the cam follower finger 38 and the adjustable cam 33 as illustrated in FIG. 4 and when the wedge 40 is in its extreme right-hand position as illustrated in FIG. 4, the finger 39 of the wedge member 40 cooperates with the cam follower 31 and the adjustable cam 33 so that when the temperature setting dial 35 is set for a selected temperature as illustrated in FIG. 1, the bimetal member 29 will cause the switch operator 26 to control the heat exchange system to tend to maintain its output temperature effect at the temperature setting of the dial 35. However, when the wedge member 40 is axially moved to the left from the position illustrated in FIG. 4, such as to the position illustrated in FIG. 5, the wedge finger 39 thereof is further inserted between the cam follower finger 39 and the adjustable cam 33 to spread the same further apart so as to change the temperature setting of the bimetal member 29. Thus, the bimetal member 29 will now maintain the output temperature effect of the heat exchange unit at a lower temperature than the temperature setting of the dial 35 as will be apparent hereinafter.

The wedge member 40 is normally urged to its extreme right-hand position of FIG. 4 by a tension spring 50 having one end 51 fastened to the wedge member 40 and the other end 52 thereof secured to a spring retainer 53 carried by the pin 41.

An actuator member of lever 54 is pivotably or rotatably carried by the frame means 11 on a pivot pin 55 thereof, the actuator member 54 having an outwardly directed post 56 for acting against an end surface 57 of the wedge member 40 in a manner hereinafter described.

The lower end 58 of the actuator member 54 cooperates with a detent member 59 in such a manner that an elbow 60 of the detent member 59 is adapted to be received in a right-hand notch 61 of the actuator member 54 when the actuator member 54 has been pivoted in a clockwise direction to the position illustrated in FIG. 4 or to be received in another notch 62 thereof when the actuator member 54 has been pivoted in a counterclockwise direction as illustrated in FIG. 5.

When the actuator member 54 is pivoted from the position illustrated in FIG. 4 to the position illustrated in FIG. 5, the post 56 thereof is adapted to act against the surface 57 of the wedge member 40 and move the same from its extreme right-hand position in FIG. 4 to a left-hand position of FIG. 5 to cause a cut-back setting of the thermostat arrangement 21.

However, when the adjustable pin 41 is set in the extreme lower end 63 of the arcuate slot 43, the movement of the actuating member 54 from the position of FIG. 4 to the position of FIG. 5 will not cause any leftward movement of the wedge member 40 so that there will be no cut back in the temperature setting of the thermostat construction 10. Conversely, the further the pin 41 is set in the arcuate slot 43 toward the extreme upper end 64 thereof, the greater the amount of degree cut back that will be provided as the wedge member 40 will be moved a greater distance to the left when the actuating member 54 is moved from the first position of FIG. 4 to the second position of FIG. 5.

In order to move the actuator member 54 from the normal position of FIG. 4 thereof to the temperature cut back position of FIG. 5, the timer dial member 16 carries an adjustable cut-back tab 65 on the outer periphery 66 thereof as well as another adjustable tab 67 for returning the actuating member 54 from the temperature cut-back position thereof of FIG. 5 to the normal temperature setting position of FIG. 4 thereof. The cut-back tab 65 and return tab 67 each has an arm 68 thereof rotatably mounted about a sleeve portion 69 of the timer dial member 16 and is held in a selected rotational position relative to the timer dial member 16 by having an abutment 70 thereof received in a selected notch 71 between a pair of ratchet-like teeth 72 annularly formed on the under surface 73 of the dial member 16 as illustrated in FIG. 2.

Thus, by pushing inwardly on the tab 65 or 67, the abutment 70 thereof will be freed from the ratchet teeth 72 so that the tab 65 or 67 can be rotated relative to the dial member 16 to a desired selected time position thereof and then be released whereby the natural resiliency of the arm 68 of the tab 65 or 67 will return the abutment 70 thereof back into a notch 71 of the dial member 16 so that the tab 65 or 67 will now rotate in unison with the dial member 16 as the dial member 16 is rotated by the electrical timer motor interconnected thereto by the gear train 18.

The tab 65 carries a cam surface 74 for engaging against a post 75 of the actuator member 54 on the left side thereof as illustrated in FIG. 5 to cam the actuator member 54 in a counterclockwise direction about its pivot pin 55 from the position illustrated in FIG. 4 to the position illustrated in FIG. 5 to the position illustrated in FIG. 5 to cause a cut back in the temperature setting of the thermostat construction 10 in the manner previously described at the time that the tab 65 reaches the pin 75 of the actuating member 54 as illustrated in FIG. 5. Thus, it can be seen that setting the tab 65 at the desired time relative to the dial member 16 will cause the thermostat construction 10 to turn back the temperature setting of the heat exchange means automatically at the time selected by the operator.

Similarly, the return tab 67 of the dial member 16 has a cam surface 76, FIG. 3, which will cam against the pin 75 of the actuator member 54 on the right side thereof to thereby cam the actuator member 54 in a clockwise direction from the position illustrated in FIG. 5 back to the position illustrated in FIG. 3 at the time the return tab 67 is in a position adjacent the post 75 of the actuator member 54 whereby the time for returning the thermostat construction 10 back to its normal time can be selected by the operator merely positioning the tab 67 adjacent the desired time on the dial member 16 in the manner previously described.

Thus, it can be seen that the thermostat construction 10 of this invention can be formed a relatively few parts to operate in a manner now to be described.

The operator selects the time desired for the thermostat construction 10 to cut back the temperature setting thereof by positioning the tab 65 relative to the dial member 16 for the desirred cut-back time, such as 11:00 P.M., and sets the tab 67 relative to the dial member 16 for the desired time that the thermostat construction 10 is to return the temperature setting thereof from its night-time setting to its day-time setting, such as at 9:00 A.M.

The operator sets the temperature setting dial 35 at the desired temperature thereof for day-time operation which in the example illustrated in FIG. 1 is a 70° F. The operator also sets the knob 46 of the set-back actuator 54 to the desired number of degrees that the thermostat construction 10 is to cut back the thermostat setting for night-time operation of the heat exchange system and in the embodiment illustrated in FIG. 1, the knob 46 is set for a 5° cut back whereby the thermostat construction 10 will cut back the temperature setting from the normal day-time setting of 70° F to 65° F for night-time operation.

In particular, during the day-time operation of the thermostat construction 10 as illustrated in FIG. 4, the actuator member 54 is in the day-time setting position of FIG. 4 whereby the wedge member 40 is in its extreme righthand position so that the cam follower 31 cooperates with the finger 49 of the wedge member 40 and the adjustable cam 33 to cause the bimetal member 29 to turn on the heat exchange means when the temperature being sensed by the bimetal member 29 falls below the setting of the dial 35, which in the example given is 70 ° F, by having the switch operator 26 moved against or closely adjacent the outer periphery 27 of the switch unit 22. Conversely, should the output temperature effect of the heat exchange means exceed the temperature setting of the temperature dial 35, the bimetal member 29 moves the switch operator 26 away from the switch construction 22 so that the switch construction 22 will turn off the heat exchange unit until the output temperature effect thereof again falls below the setting of the dial 35.

Thus, the bimetal member 29 will cycle on and off the switch construction 22 to tend to maintain the output temperature effect of the heat exchange means at the day-time setting of the dial 35.

However, when the timer dial 16 reaches the 11:00 P.M. position thereof, the cut-back tab 65 has its cam surface 74 now operate or cam against the post 75 of the actuator member 74 to cause the same to rotate in a counterclockwise direction from the position illustrated in FIG. 4 to the position illustrated in FIG. 5 whereby the post 56 of the actuator member 54 shoves the wedge member 40 to the left and thereby inserts a wider portion of the finger 49 between the cam follower 31 and the adjustable cam 33 to reset the temperature condition of the bimetal member 29 in such a manner that the switch operator 26 will not turn on the heat exchange unit until the output temperature effect thereof falls to 65° F.

Thus, the thermostat construction 10 in its cut-back condition of FIG. 5 maintains the output temperature effect of the heat exchange unit at 65° F by cycling the operator 26 relative to the switch unit 22 in the new condition of the cam follower 31 as illustrated in FIG. 5.

Subsequently, when the timer dial member 16 reaches the 9:00 A.M. position thereof, the return tab 67 has its cam surface 76 now operating against the post 75 of the actuator member 54 in the manner illustrated in FIG. 3 to cause clockwise movement of the actuator member 54 from the position illustrated in FIG. 5 back to the position illustrated in FIG. 3 whereby the spring 50 is adapted to move the wedge member 40 back to the extreme right-hand position of FIG. 4. In this manner, the cam follower 31 is now moved closer to the cam 33 so that the bimetal member 29 is now set at the 70° F position thereof whereby the bimetal member 29 will cycle the switch operator 26 relative to the switch 22 to tend to maintain the output temperature effect of the heat exchange means at the actual temperature of the dial member 35 in the manner previously described.

From the above, it can be seen that the thermostat construction 10 of this invention is adaped to automtically cut back the thermostat setting of the thermostat arrangement 21 thereof from its normal day-time setting to a night-time setting and then automatically return the setting of the thermostat arrangement 21 back to its day-time setting at predetermined times as selected by the tabs 65 and 67 in the manner previously described.

Thus, it can be seen that this invention provides an improved cut-back thermostat construction having many novel and unique features.

While the thermostat construction 10 has been previously described as automatically adjusting the thermostat arrangement 21 by changing the temperature responsive switch operator 26 by the wedge member 40, it is to be understood that the wedge member 40 can be utilized to change the position of the switch 22 relative to the switch operator 26 for temperature cut back purposes.

Figure 6:
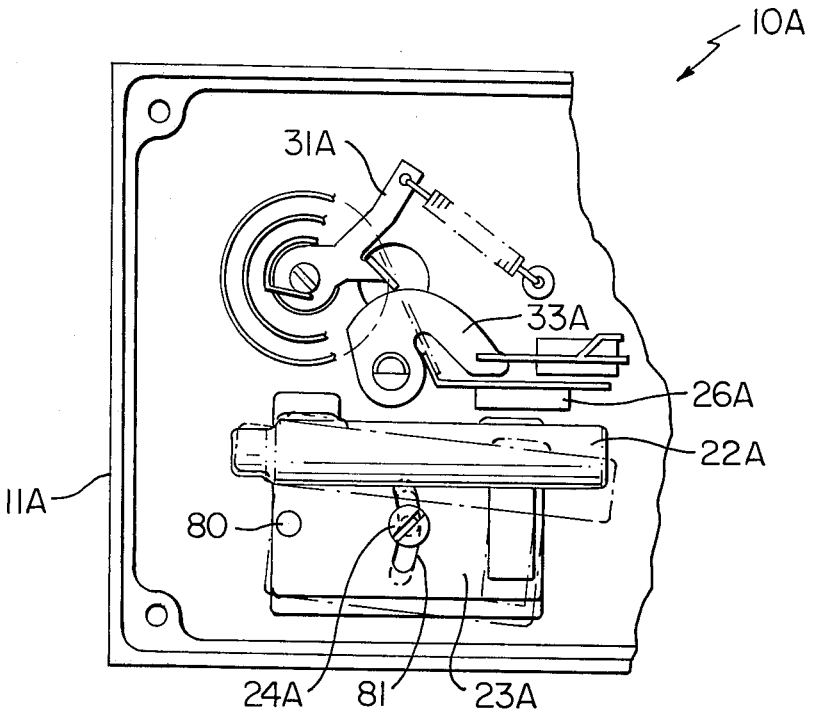
FIG. 6 is a view similar to FIG. 5 and illustrates another embodiment of the thermostat construction of this invention.

For example, reference is now made to FIG. 6 wherein another embodiment of the thermostat construction of this invention is generally indicated by the reference 10A and parts thereof similar to the thermostat construction 10 previously described are indicated by like reference numerals followed by the reference letter A.

As illustrated in FIG. 6, the wedge member 40 previously described is removed from operation between the cam follower 31A and adjustable cam 33A and is adapted to be interconnected to the plate 23A for the switch 22A in any suitable manner to cause the plate 23A to pivot relative to the frame means 11A for temperature cut back purposes.

For example, the plate 23A can be pivotally mounted to the frame 11a by a pivot pin 80 and the fastening member 24A can pass through an arcuate slot 81 in the plate 23A to provide for pivoting movement of the plate 23A relative to the frame means 11A.

Alternately, the plate 23A could be made movable in a linear manner relative to the frame means 11a if desired.

Figure 7:
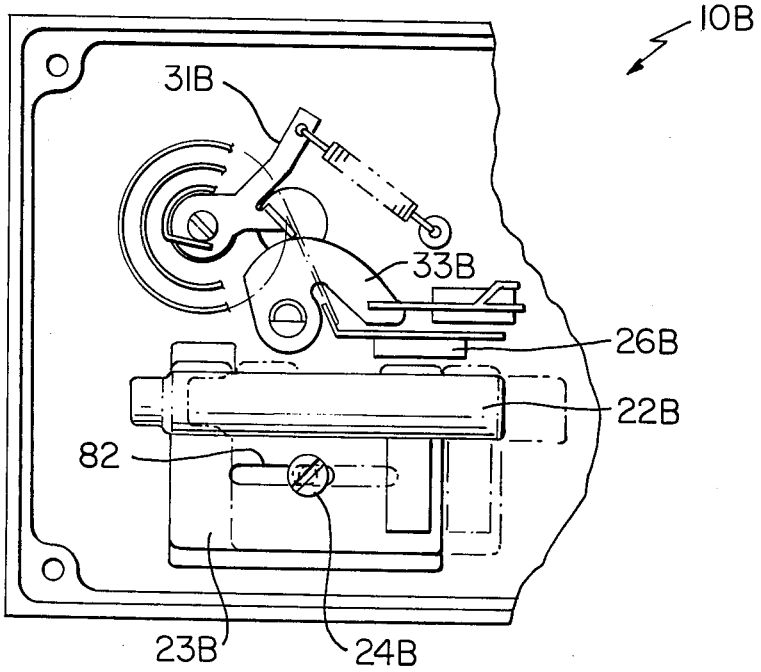
FIG. 7 is a view similar to FIG. 6 and illustrates another embodiment of the thermostat construction of this invention.

For example, reference is now made to FIG. 7 wherein another embodiment of the thermostat construction of this invention is now indicated by the reference numeral 10B and parts thereof similar to the thermostat constructions 10 and 10A previously described are indicated by like reference numerals followed by the reference letter B.

As illustrated in FIG. 7, the plate 23B carries the switch unit 22B and has an elongated horizontally disposed slot 82 provided therein and receiving the fastening member 24B therethrough in such a manner that the plate 23B is adapted to be moved linearly in a horizontal manner in FIG. 7 as indicated by full and dash dot lines in FIG. 7 by the wedge member 40 previously described being moved in right and left directions. Thus, the position of the switch unit 22B is adjusted relative to the magnetic field of the switch operator 26B to cause the switch operator 26B to vary its operation of the switch unit 22B.

In this manner, it can be seen that the thermostat constructions 10A and 10B are each adapted to have the temperature setting thereof for day-time operation set by the cam member 33A or 33B and then have the normal day-time temperature setting thereof cut back by moving the switch 22A or 22B relative to the switch operator 26A or 26B at a predetermined time period as selected by the timer means, the switch 22A of the thermostat construction 10A of FIG. 6 being adjusted relative to the switch operator 26 by being pivoted relative thereto, whereas the switch 22B of the thermostat construction 10B is adjusted relative to the switch operator 26B by being moved linearly relative thereto as illustrated in FIG. 7.

Thus, it can be seen that this invention provides improved cut-back thermostat constructions having many novel and unique features.

While the forms of the invention now preferred have been illustrated and described as required by the Patent Statute, it is to be understood that other forms can be utilized and still fall within the scope of the appended claims.

What is claimed is:

1. A cut-back thermostat construction having a frame means, a timer means carried by said frame means, a thermostat arrangement carried by said frame means, movable actuator means carried by said frame means and being operatively associated with said thermostat arrangement to cut back the temperature setting thereof when said actuator means is moved from a first position thereof to a second position thereof, said timer means having cut-back means for engaging and moving said actuator means from said first position thereof to said second position thereof when a predetermined time is reached by said timer means whereby the temperature setting of said thermostat arrangement is cut back at said predetermined time, said thermostat arrangement comprising an electrical switch means carried by said frame means and a temperature responsive switch operator movably carried by said frame means for operating said switch means in accordance with sensed temperature, said actuator means cutting back said temperature setting of said thermostat arrangement by adjusting said temmperature responsive switch operator relative to said switch means, and an adjustable cam being carried by said frame means and being operatively associated with said temperature responsive switch operator to set the same to provide said temperature setting of said thermostat arrangement, said switch operator having a cam follower operatively associated with said cam for following the adjustment thereof, said actuator means including a movable wedge member disposed between and in engagement with said cam follower and said cam.

2. A cut-back thermostat contruction as set forth in claim 1 wherein said timer means includes a rotatable time indicating dial, said cut-back means being carried by said dial.

3. A cut-back thermostat construction as set forth in claim 2 wherein said cut-back means is adjustably carried by said dial to be set in different time positions therewith for selecting the desired predetermined time for cutting back said thermostat arrangement.

4. A cut-back thermostat construction as set forth in claim 3 wherein said cut-back means comprises an adjustable tab carried by said dial and extending outwardly from the outer periphery of said dial.

5. A cut-back thermostat construction as set forth in claim 1 wherein said timer means has return-means for engaging and moving said actuator means from said second position thereof back to said first position thereof when another predetermined time is subsequently reached by said timer means whereby the temperature setting of said thermostat arrangement is returned to its normal setting.

6. A cut-back thermostat construction as set forth in claim 5 wherein said timer means includes a rotatable time indicating dial, said cut-back means and said return-means being carried by said dial, said cut-back means and said return means being adjustably carried by said dial to be set in different time positions therewith for selecting the desired predetermined time for cutting back said thermostat arrangement and for returning said thermostat arrangement to its normal setting, said cut-back means and said return means each comprising an adjustable tab carried by said dial and extending outwardly from the outer periphery of said dial.

7. A cut-back thermostat construction having a frame means, a timer means carried by said frame means, a thermostat arrangement carried by said frame means, and movable actuator means carried by said frame means and being operatively associated with said thermostat arrangement to cut back the temperature setting thereof when said actuator means is moved from a first position thereof to a second position thereof, said timer means having cut-back means for engaging and moving said actuator means from said first position thereof to said second position thereof when a predetermined time is reached by said timer means whereby the temperatuure setting of said thermostat arrangement is cut back at said predetermined time, said thermostat arrangement comprising a plate movably carried by said frame means and a magnet operated electrical switch unit secured to said plate, said thermostat arrangement further comprising a manually adjustable temperature responsive permanent magnet carried by said frame means for operating said switch unit in accordance with sensed temperature, said actuator means being operatively associated with said plate to move the same relative to said permanent magnet to cut back the temperature setting of said thermostat arrangement when said actuator means is moved from said first position thereof to said second position thereof.

8. A cut-back thermostat contruction as set forth in claim 7 wherein said plate is pivotally movable relative to said frame means.

9. A cut-back thermostat construction as set forth in claim 7 wherein said plate is linearly movable relative to said frame means.

10. A cut-back thermostat construction as set forth in claim 7 wherein said temperature responsive permanent magnet comprises a bimetal member adjustably carried by said frame means and carrying a permanent magnet.

11. A cut-back thermostat construction as set forth in claim 1 wherein said actuator means also includes a movable lever for moving said wedge member when said lever is moved between said first position and said second position by said cut-back means engaging said lever.

12. A cut-back thermostat construction as set forth in claim 11 wherein said lever is adjustable relative to said frame means to select the amount of movement of said wedge member and, thus, the amount of cut-back temperature for said thermostat arrangement.

13. A cut-back thermostat construction as set forth in claim 7 wherein said timer means includes a rotatable time indicating dial, said cut-back means being carried by said dial.

14. A cut-back thermostat construction as set forth in claim 13 wherein said but-back means is adjustably carried by said dial to be set in different time positions therewith for selecting the desired predetermined time for cutting back said thermostat arrangement.

15. A cut-back thermostat construction as set forth in claim 14 wherein said cut-back means comprises an ajustable tab carried by said dial and extending outwardly from the outer periphery of said dial.

16. A cut-back thermostat construction as set forth in claim 7 wherein said timer means has return-means for engaging and moving said actuator means from said second position thereof back to said first position thereof when another predetermined time is subsequently reached by said timer means whereby the temperature setting of said thermostat arrangement is returned to its normal setting.

17. A cut-back thermostat construction as set forth in claim 16 wherein said timer means includes a rotatable time indicating dial, said cut-back means and said return-means being carried by said dial, said cut-back means and said return means being adjustably carried by said dial to be set in different time positions therewith for selecting the desired predetermined time for cutting back said thermostat arrangement and for returning said thermostat arrangement to its normal setting, said cut-back means and said return means each comprising an adjustable tab carried by said dial and extending outwardly from the outer periphery of said dial.

* * * * *